US005245717A

United States Patent [19]

Rudy

[11] Patent Number: 5,245,717

[45] Date of Patent: Sep. 21, 1993

[54] RELAXATION ARTICLE WITH A BOOK PODIUM

[76] Inventor: Christopher J. Rudy, 4541 31st Avenue South, Minneapolis, Minn. 55406-3808

[21] Appl. No.: 953,655

[22] Filed: Sep. 29, 1992

[51] Int. Cl.[5] ..... A47C 21/00; A47G 9/00

[52] U.S. Cl. ..... 5/507.1; 2/69; 5/482; 5/485; 5/658; 248/441.1

[58] Field of Search ..... 5/482, 485, 494, 1, 5/503.1, 507.1, 658; 2/69, 69.5, 114; 248/441.1, 459; 128/856

[56] References Cited

U.S. PATENT DOCUMENTS

| | | | |
|---|---|---|---|
| 156,360 | 10/1974 | Levy | 2/69 |
| 1,707,766 | 4/1929 | Page | 5/639 |
| 1,802,540 | 4/1931 | Schmidt | 2/114 |
| 1,928,806 | 10/1933 | Barcalo | 5/639 |
| 2,408,357 | 10/1983 | Toth | 2/114 |
| 3,794,284 | 2/1974 | Guenther | 248/441.1 |
| 4,062,076 | 12/1977 | Albertson | 5/482 |
| 4,607,817 | 8/1986 | Aquino | 248/459 |

FOREIGN PATENT DOCUMENTS

| | | | |
|---|---|---|---|
| 211043 | 6/1957 | Australia | 2/69 |
| 18282 | 12/1912 | Denmark | 2/69 |
| 346508 | 7/1960 | Switzerland | 2/69.5 |

*Primary Examiner*—Alexander Grosz

[57] ABSTRACT

Relaxation article can include a flat flexible member, e.g., a blanket, having an opening to an attached sleeve. A person's arm can be inserted through the opening and into the sleeve. An object holding or positioning member such as a pocket, book podium, light, etc., may be included. The book podium, which may be separable, may be pillowed or have a transparent shelf for placing a book reading side down to read through upwardly.

11 Claims, 2 Drawing Sheets

FIG. 1
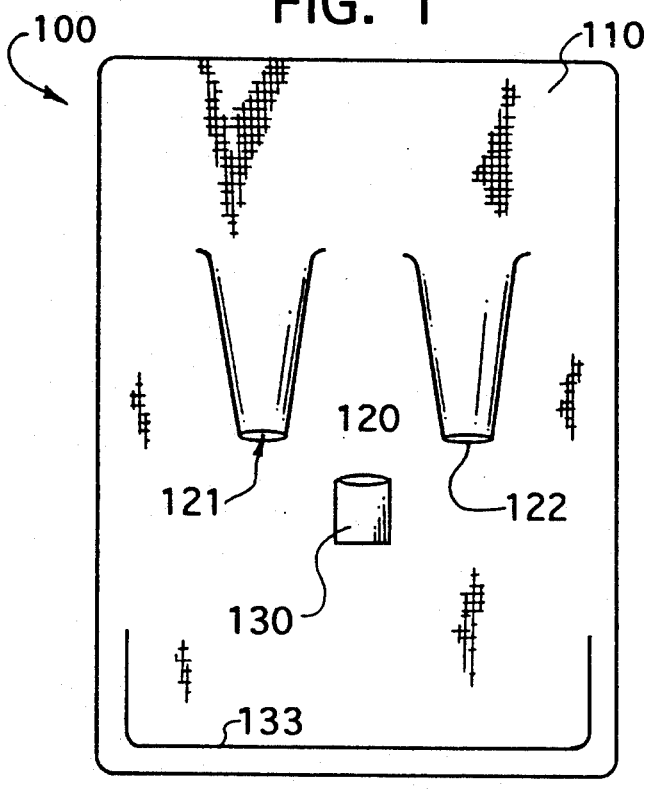
FIG. 2
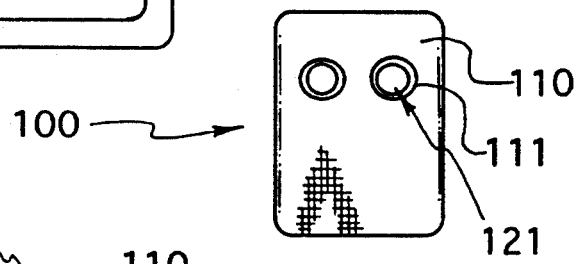
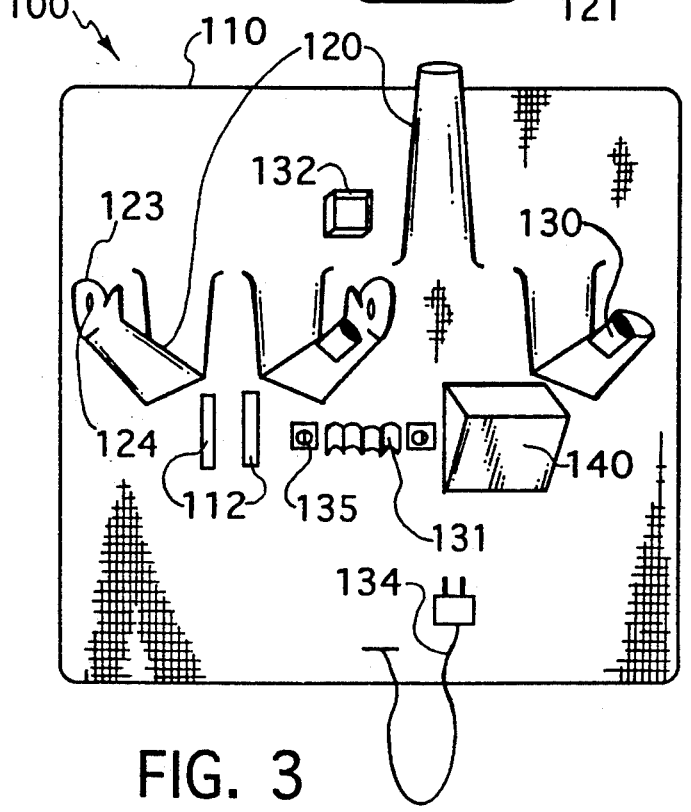
FIG. 3

RELAXATION ARTICLE WITH A BOOK PODIUM

FIELD

Of concern here is an article, e.g., blanket or other object, useful while relaxing to comfortably hold such items as books and writing pads.

BACKGROUND

Many people tend to retire to their bed or favorite easy chair to read before actually falling asleep. Others undertake such activities as knitting before retiring, or read, knit, etc., at other relaxation times. Others, like students, find they must study in bed. Such a period of physical inactivity may engender an uncomfortable coolness overtaking the person, especially about the arms and shoulders, and this often results in early cessation of the desired activity. Plus, holding of a book, writing pad, embroidery hoop, knitting piece, or positioning of reading light, etc., can be tiresome, and the item is set aside prematurely for this reason, too. A conventional blanket offers little if any relief from the undesired coolness of the arms and shoulders and itself is of virtually no help with added holding or positioning.

In addressing the problem, Albertson, U.S. Pat. No. 4,062,076, provided slits, optionally with flaps, e.g., imitating eyelids of pictoral eyes, in a bedcovering. They allow for egress of arms of a reader to hold a book. Yet, that provision leaves the reader in particular with cold arms. As well, it by itself is of virtually no help with the added holding or positioning problems.

The art lacks and needs a pleasing, effective solution to problems remaining while partaking of such time honored pastimes.

INVENTION SUMMARY

Provided is a relaxation article, which may include a flat flexible member having therein an opening and attached thereto a sleeve with its interior passageway in communication with the opening such that a person's arm can be inserted through the opening and into the sleeve interior. The article can embrace an object holding/positioning member, e.g., a book podium, etc.

The invention is useful in providing comfort and pleasure.

By the invention problems in the art are finally solved. No longer need there be experienced the discomfort of cold arms and shoulders during relaxation activities such as reading in bed. No longer need reading or studying in bed be accompanied by the difficulties of holding a book or writing pad in an uncomfortable position. No longer need items or accessories wished to be close at hand be out of reach. Solutions afforded hereby are provided in a pleasing manner to the surprise and delight of users.

Numerous further advantages attend the invention.

DRAWINGS

Figure 4:
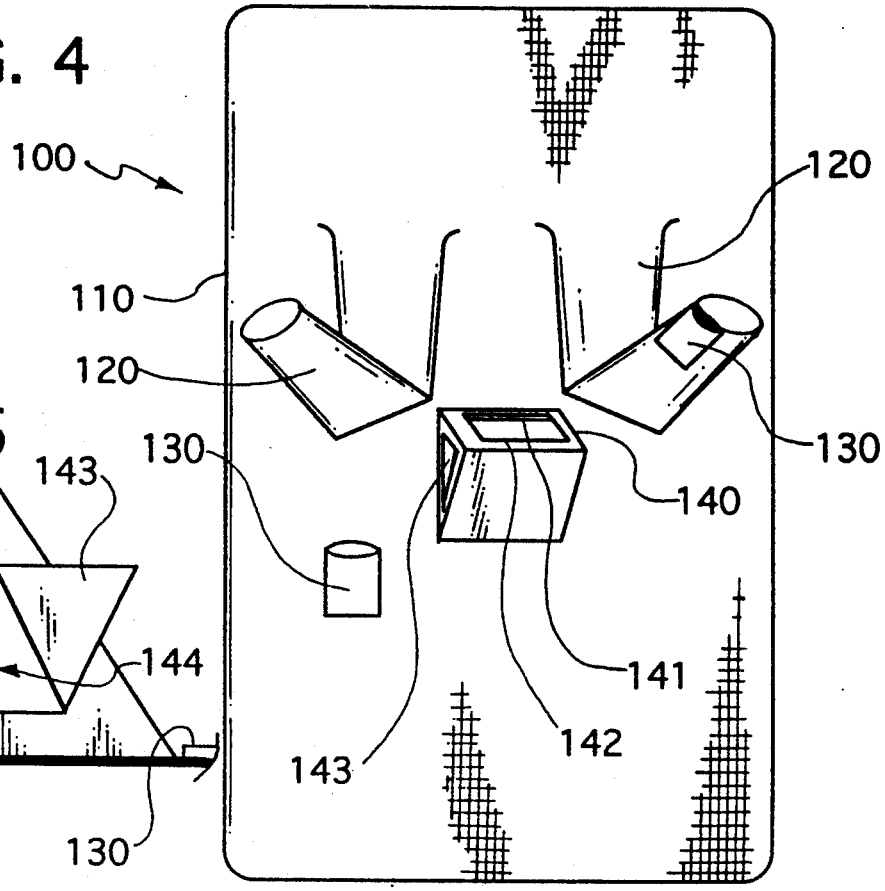
Figure 5:
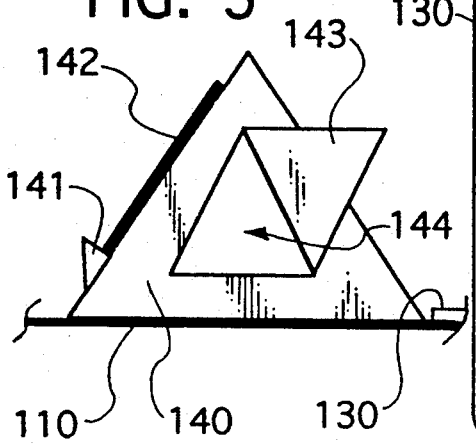
Figure 6:
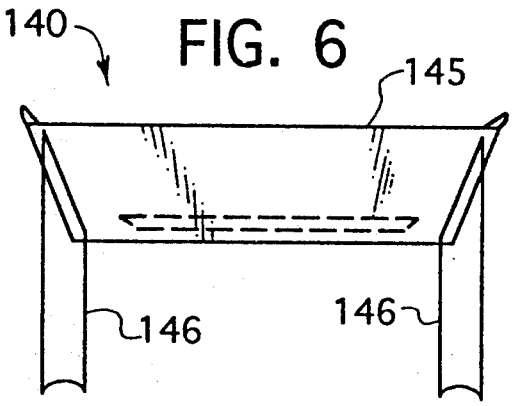
Figure 7:
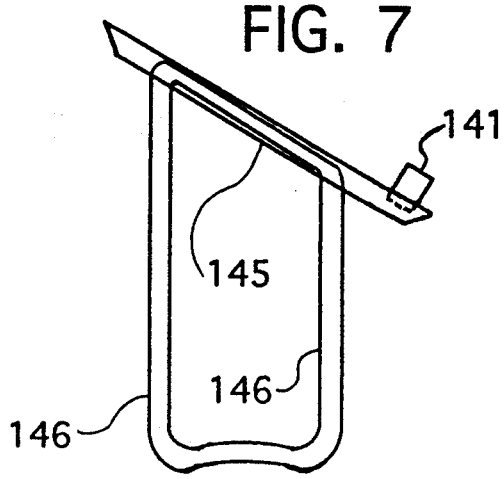

The drawings form part of the specification hereof. FIG. 1 is a top view of an embodiment of the invention. FIG. 2 is a bottom view of an article as of FIG. 1. FIG. 3 is a top view of an embodiment including a book podium. FIG. 4 is a top view of another embodiment with a book podium. FIG. 5 is a side view of part of the article of FIG. 4. FIG. 6 is a front view of another book podium embodiment. FIG. 7 is a side view of the article of FIG. 6.

FURTHER DETAIL

The aforesaid Albertson patent is incorporated by reference.

The relaxation article may be embodied to embrace the flat flexible member with the opening(s) and sleeve(s). It further generally may include the object holding/positioning member(s), or especially be embodied as the book podium itself.

Herein, terms are defined to include as follows:

"Flat flexible member" can include a substantial part of an article embodied in the present invention, generally resembling in significant measure part of a known blanket, comforter, quilt, afghan, bedspread, bedsheet, throw, tarp, space blanket, or other similar woven, loomed, layered, sewn, knitted, crocheted, and/or acceptably manufactured textile and/or plastic sheetlike item.

"Arm" generally includes any of hand, forearm, and upper arm.

"Object holding/positioning member" broadly includes a part, feature, or item hereof, which can hold or position an object such as any of a book, writing pad, pencil, pen, bottle such as for elixir, liquid medicine, pill, or liquor, knitting piece, yarn, spool of thread, knitting needle, pack of enclosed, pinned or otherwise secured or attached sewing needles, embroidery hoop, reading light, candy bar, etc., and thus, it can include the book podium, a pocket, an elastic loop, a reading light support, etc.

In reference to the drawings, flat flexible member embracing relaxation articles are depicted within FIGS. 1–5. Book podium embracing relaxation articles are depicted within FIGS. 3–7. In the drawings, like numerals refer to like features:

Relaxation article 100 has flat flexible member 110 and a plurality of openings 111 which an arm may pass through. The openings may be any suitable size but are desirably large, say, about double the size of sleeve openings as present on shirts or blouses so that there is ample room should the user fall asleep; thus, circulation or nerve impulses might not be readily impeded. Attaching/detaching strips 112 such as one of a hook and loop pair as may be commercially obtainable as VELCRO may be present, to which may be attached a pocket, podium, etc., as the case may be. The article also has a plurality of sleeves 120, which are preferably amply provided so as to be relatively loose. An arm can pass through opening 111 into sleeve interior 121. Cuff 122 may be present about an open end of a sleeve out from the opening in the flat flexible member. Optional attachable/detachable or permanently affixed mitten(s) 123 may be present, which may be provided with finger slit(s) 124 to poke out a finger so as to facilitate turning pages of a book, and so forth. Pocket 130 may be provided to be attachable/detachable as from use of the strips or permanently affixed. The pocket may be present at any convenient location such as on the flat flexible member, on a sleeve, etc., so as to be available for insertion of a book, pen, knitting supplies, etc. Elastic loops 131 may be present and are especially useful for insertion of pens, pencils, knitting needles, and the like. A light stand support 132 may be present, and it may simply be a boxlike frame whether firmly free standing or loose; it may have a suitable electrical supply handy within provided from a power source, as for powering a reading light. Glow in the dark border 133 helps identify the article and helps keep users from stubbing their toes on furniture covered with it, e.g., bed, couch, love seat, etc., when one walks about the room in the dark. Electrical supply line 134 may be present such as to power the reading light to be held by the light stand support or to heat the article as the case with conventional electric blankets, and so, lighting/heating controls 135 may be provided. Book podium 140 may be present; it may be attachable/detachable as aforesaid, be permanently affixed, or be a separate item. It may be a pillowed wedge, free standing and of a soft upholstered material, or be of any suitable material. It may have book stop 141 for resting a book while reading and/or hard writing surface 142. It may be stuffed solid, or be hollow, and if hollow, it may have access space panel 143 closing access space hollow 144 by suitable means such as zippers, buttons, ties, snaps, hooks and loops, etc. In another aspect, podium 140 has see through panel 145 such as provided by clear polymethylmethacrylate as PLEXIGLASS, polycarbonate, glass, etc., upon which a book may be placed open side down and read upwardly through the panel. Supports 146 are generally present to support the panel at an appropriate height and may be adjustable. Thus, holding a book can now be relaxing!

In general, the article can be made by known methods.

An article with a flat flexible member and sleeve(s) may have these of the same material, e.g., the flat flexible member and sleeve(s) can be knit of the same yarn in one-piece or have its sleeve(s) sewn on. Typically, such articles are soft and supple. Pockets may be similarly constructed and attached, especially as by sewing, if not attachable as by hooks and loops, etc. Thus, such an article aids in providing comfort to the user. Also the wedge shaped book podium may be considered to be a pillow as it may be soft and stuffed, to some degree; it may be made of soft cloth covering a frame or triangularly shaped construction of suitably strong supportive foam pieces or be a combination of such. The book stop may be similarly made of a suitably strong material, including appropriate foam, covered with soft or more tough cloth that can withstand having a book edge repeatedly contacting it. The hard writing surface may be of wood, plastic, leather, etc., and be attachable or attached to the wedge by hooks and loops, glue, rivets, sewing, etc. Supports for the book podium with the see through panel can be of any suitable material that keeps the panel in a position so that a book resting upside down on its surface may be read as from under and through the panel when it is in position for preferred use; such includes wood, metal, plastic in dowels, rods, boards, panels, I-bars, or other format. Its book stop can be a suitable material such as wood, metal, or plastic. Such a book podium can be made by standard methods such as casting, forming, screwing, gluing, extrusion, etc.

CONCLUSION

The present invention is thus provided. Numerous modifications can be effected within its spirit, the distinctly asserted scope of which is particularly pointed out as follows.

I claim:

1. A relaxation article adapted to cover at least the upper body portions of a user reclining in a bed, easy chair or the like, said relaxation article providing means adapted to support a book or a writing pad for the reclining user, said relaxation article comprising a flat flexible insulating member having therein at least two spaced openings and attached to each opening a sleeve having an interior passageway with the interior passageway in communication with the opening such that a person's arm can be inserted through the opening and into the interior passageway of the sleeve, said means comprising a generally wedge shaped book podium attached to said flexible member, said book podium comprising a hard, generally planar surface with a book stop, for supporting a writing pad or a book.

2. The article of claim 1, wherein the book podium is releasably attached to the flexible member with the aid of separable fasteners.

3. The article of claim 1, wherein a lower edge of the flexible member is adapted to cover the feet of a user.

4. The article of claim 1, wherein the book podium is hollow.

5. The article of claim 4, wherein the hollow portion of the book podium defines a storage area.

6. The article of claim 5, wherein the book podium has an access panel providing access to the hollow storage area.

7. The article of claim 1, wherein the flexible member is provided with electrical heating means.

8. The article of claim 1, further comprising lighting means.

9. The article of claim 1, further comprising pocket means.

10. The article of claim 9, wherein at least one pocket is provided on at least one sleeve.

11. The article of claim 1 or 2 wherein a portion of the book podium is made from soft materials.

* * * * *

UNITED STATES PATENT AND TRADEMARK OFFICE

CERTIFICATE OF CORRECTION

PATENT NO. : 5,245,717

DATED : September 21, 1993

INVENTOR(S) : Christopher John Rudy

It is certified that error appears in the above-identified patent and that said Letters Patent is hereby corrected as shown below:

Column 4:

In claim 1, line 14 thereof, i.e., at column 4, line 27, delete "comprising" and insert therefor -- having --.

Signed and Sealed this

Eighth Day of March, 1994

Bruce Lehman

*Attest:*

BRUCE LEHMAN

*Attesting Officer*

*Commissioner of Patents and Trademarks*